US006507969B2

(12) United States Patent
Spotti

(10) Patent No.: US 6,507,969 B2
(45) Date of Patent: Jan. 21, 2003

(54) MACHINE FOR WASHING CONTAINERS

(75) Inventor: Giovanni Spotti, Fidenza (IT)

(73) Assignee: R. Bardi S.R.L., Fidenza (IT)

( * ) Notice: Subject to any disclaimer, the term of this patent is extended or adjusted under 35 U.S.C. 154(b) by 75 days.

(21) Appl. No.: 09/768,386

(22) Filed: Jan. 24, 2001

(65) Prior Publication Data

US 2001/0010102 A1 Aug. 2, 2001

(30) Foreign Application Priority Data

Jan. 27, 2001 (IT) ..... PR20A0006

(51) Int. Cl.[7] ..... A47L 15/39; B08B 9/36
(52) U.S. Cl. ..... 15/60
(58) Field of Search ..... 15/59–64

(56) References Cited

U.S. PATENT DOCUMENTS 755,018 A * 3/1904 Laible ..... 15/63
870,730 A * 11/1907 Laible ..... 15/63
1,110,817 A * 9/1914 Pinkney ..... 15/60
2,111,797 A * 3/1938 Meyer ..... 15/60

FOREIGN PATENT DOCUMENTS

| | | | | |
|---|---|---|---|---|
| BE | 505993 | * 10/1951 | ..... | 15/60 |
| DE | 218 235 | 1/1910 | | |
| DE | 287491 | * 9/1915 | ..... | 15/61 |
| DE | 522 735 | 3/1931 | | |
| DE | 568 385 | 12/1932 | | |
| JP | 6-254526 | * 9/1994 | ..... | 15/59 |

* cited by examiner

*Primary Examiner*—Mark Spisich
(74) *Attorney, Agent, or Firm*—Michael Best & Friedrich LLC

(57) ABSTRACT

A machine for washing containers comprises a base structure and a plurality of brushes mounted able to rotate on the base structure to clean the outer surface of the containers. Also provided are grip organs in the form of jaws movable between an open position and a closed position and fitted with rollers interposed between the grip organs and the neck of the container. The rollers are mounted idle about an axis of rotation to generate sliding elements and allow the rotation of the container itself through the rotary action of the brushes.

8 Claims, 2 Drawing Sheets

MACHINE FOR WASHING CONTAINERS

BACKGROUND OF THE INVENTION

The present invention relates to a machine for washing containers.

In particular the present invention pertains to the sector of linear washing machines used for instance for cleaning reusable containers such as large size tanks, containing 3, 5, 6 gallons, generally applied on water dispensing apparatuses.

As is well known, linear washing machines comprise a tunnel entered by the containers which, positioned with their mouth oriented downwards, then undergo a washing both of their inner and outer walls.

For this purpose housings are used into which the neck of the containers is inserted in such a way that they present their mouths oriented downwards.

Along their path inside the tunnel the containers encounter some brushes which proceed to clean the outer walls and some nozzles which spray washing liquid inside the containers.

As regards exterior washing, in some embodiments the containers are set in rotation about their longitudinal axis by means of rotating rubber pads pressed against the bottom of the containers.

As regards interior washing, two possible embodiments are provided. In the first one the machine operates continuously, in that the nozzles follow the containers along the tunnel, whilst in the second one the machine operates intermittently, since the nozzles are fixed and interior washing is effected only when the mouth of the container is positioned over one of them.

Known washing machines present some drawbacks. In the first place the neck is not effectively cleaned externally because it is inserted in a closed housing which prevents contact with the underlying jet.

Moreover, the containers are simply inserted into the aforesaid housings which are not able to hold them. Consequently, containers are particularly unstable and any impact or failure can cause it to be upset. This possibility is particularly negative in case of shatterproof containers because the latter can become stuck inside the washing machine. In this case the machine must be stopped to free the container.

Furthermore, known washing machines comprise a rather complex series of mechanical organs that carry out the insertion and removal of the containers into and out of the respective housings.

Lastly, known washing machines do not set the containers in rotation, thereby limiting the cleaning action of the brushes, or they obtain said rotation with appropriate devices that complicate their structure and operation.

SUMMARY OF THE INVENTION

The aim of the present invention is to eliminate the aforesaid drawbacks, making available a machine for washing containers that obtains an effective cleaning of the outer surface of the containers and in particular in the neck area.

A further aim of the present invention is to obtain a greater stability of the containers inside the machine, preventing any upsets of the containers themselves.

A further purpose is to obtain the aforesaid aims in a simple, and economical way, without introducing structural or functional complications and eliminating mechanical organs at the input and output sides of the machine.

Said aims are fully achieved by the machine for washing containers, of the present invention, which is characterized by the content of the claims set out below and in particular in that it comprises means for gripping the containers by the neck provided with grip organs movable between an open and a closed position and provided with sliding elements to allow the rotation of the container itself by means of the rotary action of brushes mounted on the machine.

BRIEF DESCRIPTION OF THE DRAWINGS

This and other features shall become more readily apparent from the description that follows of a preferred embodiment illustrated, purely by way of non limiting example, in the accompanying drawing tables, in which.

DESCRIPTION OF THE PREFERRED EMBODIMENTS

With reference to the figures, the number 1 indicates a container destined to be introduced in a washing machine, in particular of the linear kind.

The container 1 is generally of a reusable kind, such as the water tanks used in dispensing devices. In this latter case, 3, 5 or 6 gallon containers are widely employed, which must undergo cleaning both of their inner and outer walls.

Figure 1:
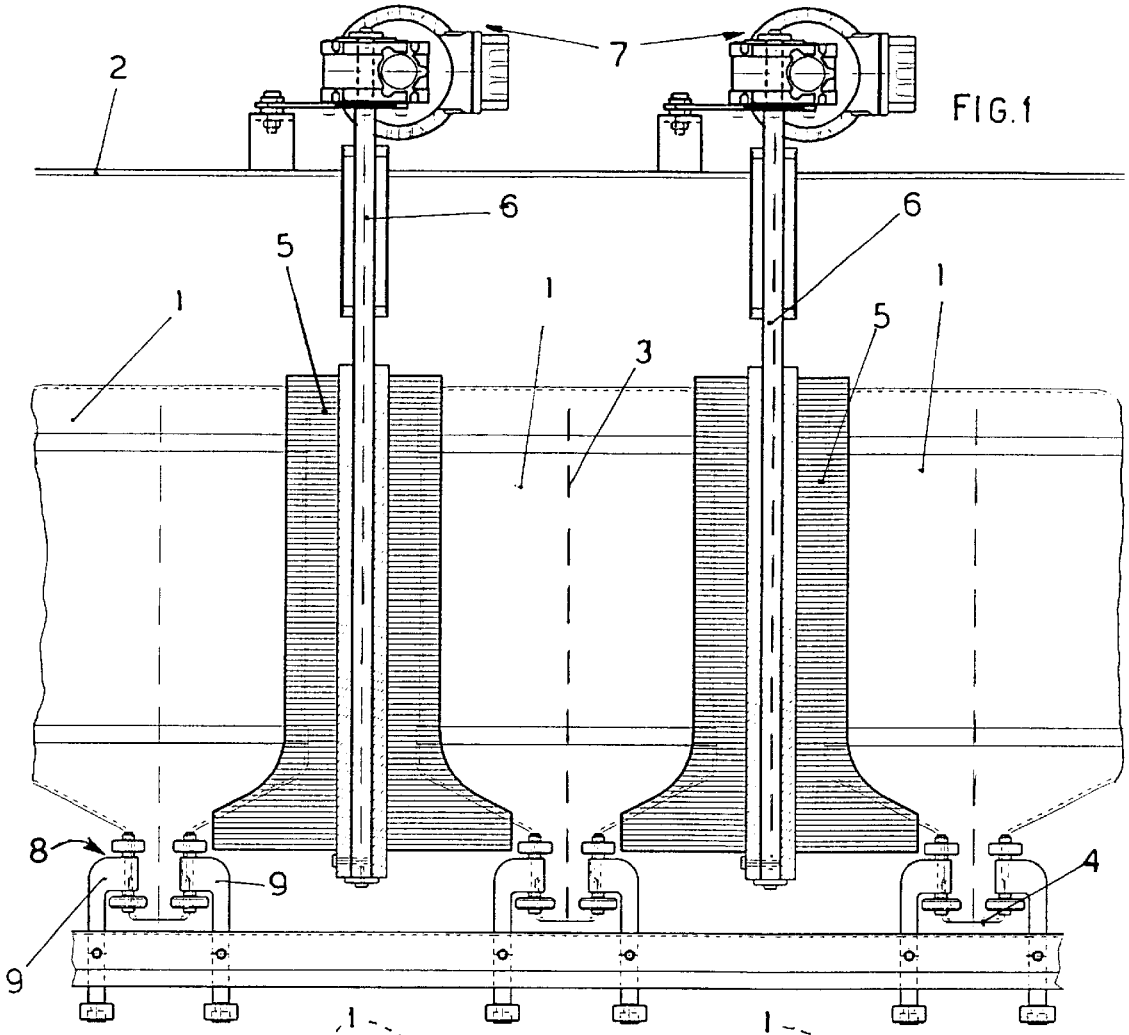
FIG. 1 shows a transverse view of a portion of a washing machine according to the present invention.

The washing machine of the present invention develops along a base structure 2, only schematically shown in the figure because it is known. The aforesaid base structure 2 constitutes a tunnel into which are introduced the containers positioned with their longitudinal axis 3 vertical and with their mouth 4 oriented downwards, as shown in FIG. 1.

Along the path followed by the containers 1 is provided a plurality of brushes 5 mounted on the base structure 2 to clean the outer surface of the containers 1. As shown in FIG. 1, every brush 5 is integral with a motorized vertical shaft 6 preferably by means of a gear motor 7.

The base structure 2 further presents a plurality of nozzles, not shown because they are substantially known. The aforesaid nozzles generate a stream, able to move according to an arched trajectory which penetrates inside the containers to wash their inner surfaces and which partially cleans the outer surface in proximity to the neck.

According to some possible embodiments, the nozzles can be fixed or movable relative to the base structure.

In the first case the motion of the containers along the base structure is intermittent and the interior washing occurs when the mouth of the container overlies a nozzle.

In the second case the motion of the containers and the interior washing is continuous because the nozzle follows the container.

Associated to the base structure 2, means 8 are provided for housing the containers positioned with their mouth oriented downwards. The aforesaid means drive the containers 1 relative to the base structure.

The aforesaid means 8 for housing the containers originally comprise grip organs 9 obtained by means of two jaws movable from an open position to a closed position in which they securely grip the neck of the container.

Each jaw 9 comprises two rollers 10 mounted about an axis of rotation 11 to constitute sliding elements interposed between the jaw and the neck of the container. The presence of the sliding elements has the purpose of allowing the rotation of the container through the rotating action of the brushes.

Figure 2:
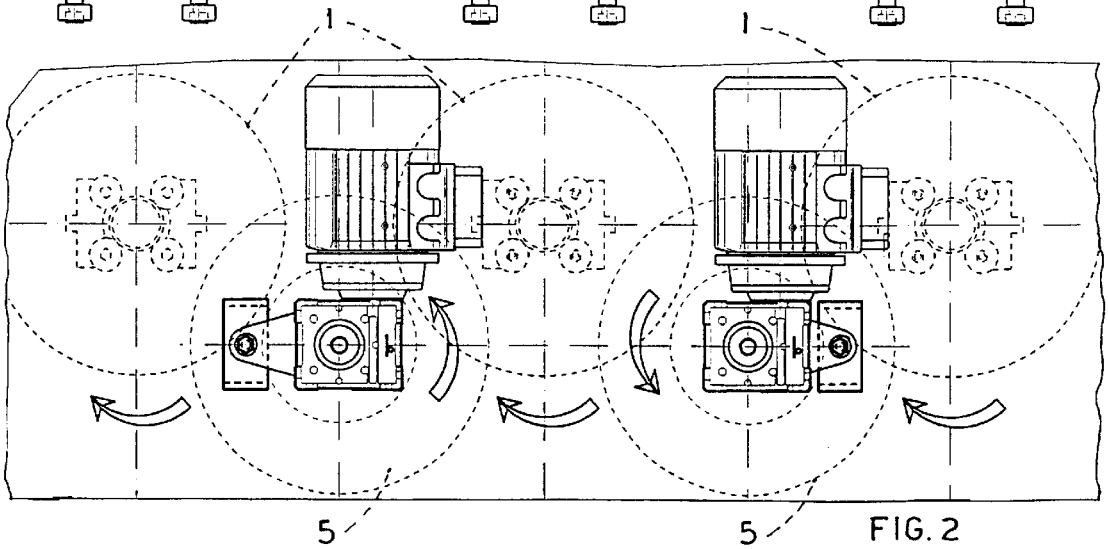
FIG. 2 shows a top view of the portion of washing machine of FIG. 1.

FIG. 2 shows the methodology for transmitting motion from the brushes to the containers and it clearly illustrates the direction of rotation of the brushes and the induced direction of rotation of the containers.

Figure 5:
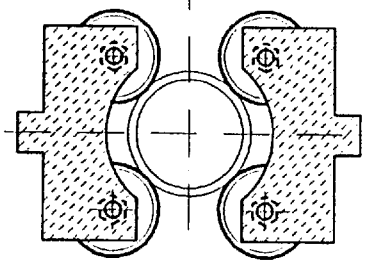
FIG. 5 shows a section view according to the straight lines V—V of the detail of FIG. 3.

As shown in FIG. 5, four rollers are provided for securely gripping the neck of the containers in four places. This configuration, together with the rotation imparted to the containers, allows to obtain an effective cleaning action also on the outer surface in proximity to the neck.

To stabilize the grip on the container, each roller 10 advantageously comprises an upper wheel 10*a* and a lower wheel 10*b* rotating about the same axis of rotation 11 in order to lock the neck of the container on two levels.

Figure 4:
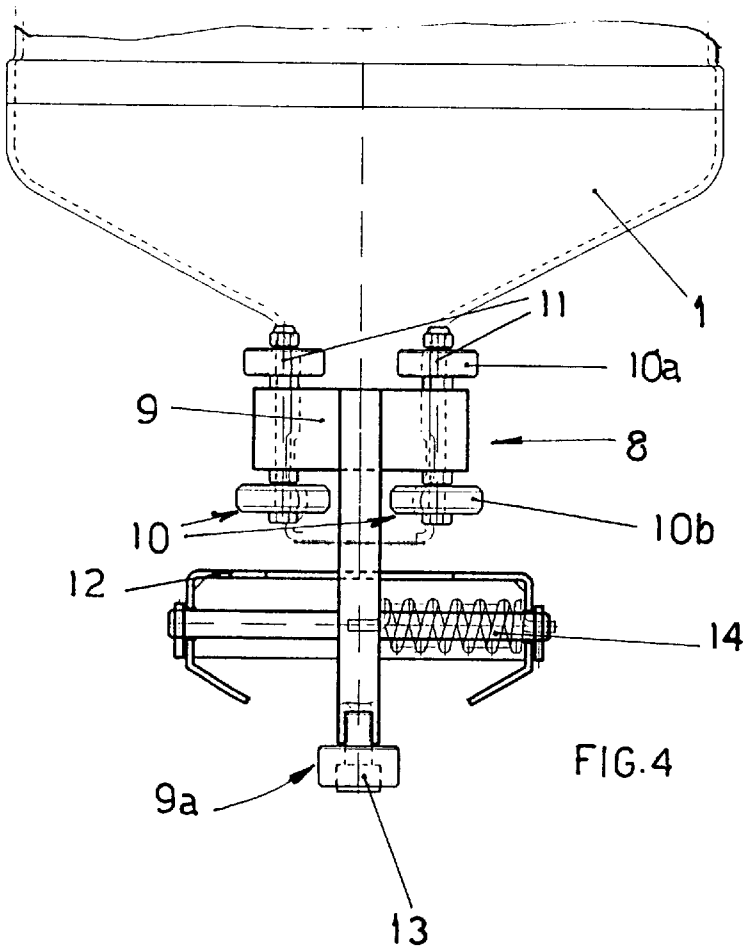
FIG. 4 shows a section view according to the straight lines IV—IV of the detail of FIG. 3.
Figure 3:
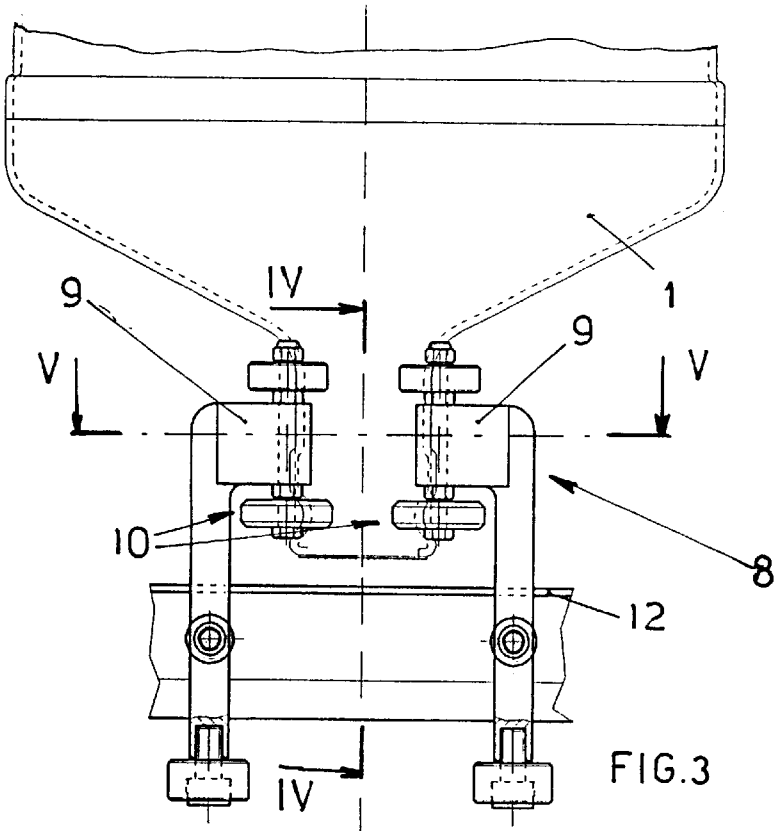
FIG. 3 shows an enlarged detail of FIG. 1.

FIG. 4 shows in detail the mounting of the jaws 9 on a support structure 12. In particular the jaws 9 are hinged to the support structure 12 and have an extremity 9*a* comprising a wheel 13 interacting with a cam, not shown herein, and integral with the base structure. Each jaw 9 further comprises an elastic element 14 interposed between the jaw and the support structure.

The interaction between the wheel and the cam causes the opening of the two jaws when gripping or releasing the container whilst the presence of the elastic element 14 maintains the jaws in closed position against each other.

According to some possible embodiment variations, the grip organs can be introduced into the mouth and act from within the neck.

Moreover, the sliding elements can also be introduced between the grip organs 9 and the respective base structure 12 to make the whole assembly, and hence the container, able to rotate.

The washing machine according to the present invention presents some important advantages. In the first place it allows for effective cleaning over the entire outer surface of the container since the latter is set in rotation about its own axis. Furthermore, said rotation is obtained without introducing structural or operating complications, but simply exploiting the rotation imparted to the brushes.

Moreover, the washing machine described above allows to handle different container formats and provides a secure and reliable grip thereof.

What is claimed is:

1. A machine for washing containers, each of the containers having a neck and a mouth, the machine comprising:

a base structure;

means for housing the containers positioned with the mouth oriented downwards, said means driving the containers relative to the base structure;

a plurality of brushes rotatably mounted on said base structure to clean the outer surface of the containers, wherein said means for housing the containers comprises a plurality of grip organs able to move between an open position and a closed position and wherein each grip organ is adapted to engage a respective container and each grip organ is adapted to engage a respective container and each grip organ is provided with sliding elements to allow the rotation of the respective container through the rotary action of the brushes as the containers are moved through the machine.

2. A washing machine as claimed in claim 1, wherein said sliding elements are interposed between the grip organs and the neck of the container.

3. A washing machine as claimed in claim 1, wherein said grip organs have at least two jaws for gripping the outer surface of the neck.

4. A washing machine as claimed in claim 3, wherein said jaws are hinged to a support structure and present an extremity interacting with a cam integral to the base structure.

5. A washing machine as claimed in claim 4, wherein each jaw has an elastic element interposed between the respective jaw and the support structure to maintain the jaws in the closed position.

6. A washing machine as claimed in claim 1, wherein said sliding elements have at least two rollers mounted on each grip organ.

7. A washing machine as claimed in claim 6, wherein each roller has an upper wheel and a lower wheel rotating about the same axis to lock the neck of the container on two levels.

8. A washing machine as claimed in claim 1, wherein said sliding elements are interposed between the grip organs and a structure for supporting the grip organs themselves.

* * * * *